US006947172B2

(12) United States Patent
Hamada et al.

(10) Patent No.: US 6,947,172 B2
(45) Date of Patent: Sep. 20, 2005

(54) FIXING DEVICE FOR IMAGE-FORMING APPARATUS

(75) Inventors: Shuta Hamada, Hachioji (JP); Satoshi Haneda, Hachioji (JP); Masahiro Onodera, Hachioji (JP)

(73) Assignee: Konica Corporation, Tokyo (JP)

( * ) Notice: Subject to any disclaimer, the term of this patent is extended or adjusted under 35 U.S.C. 154(b) by 935 days.

(21) Appl. No.: 09/774,758

(22) Filed: Jan. 31, 2001

(65) Prior Publication Data

US 2002/0018240 A1 Feb. 14, 2002

(30) Foreign Application Priority Data

Feb. 2, 2000 (JP) ..... 2000-025216

(51) Int. Cl.[7] ..... G03G 15/20

(52) U.S. Cl. ..... 358/1.7; 358/401; 399/333; 399/320

(58) Field of Search ..... 358/401, 1.7, 3.28, 358/3.29, 3.3, 3.32, 5.3; 399/320, 330, 331, 332, 334, 335, 333, 69, 323, 324, 325

(56) References Cited

U.S. PATENT DOCUMENTS 5,561,511 A * 10/1996 Mizunuma et al. ..... 399/333
5,724,638 A * 3/1998 Isogai et al. ..... 399/333

* cited by examiner

*Primary Examiner*—King Y. Poon
*Assistant Examiner*—Kyle M. Pendergrass
(74) *Attorney, Agent, or Firm*—Lucas and Mercanti, LLP

(57) ABSTRACT

A fixing apparatus for fixing a toner image on a transfer sheet, comprises a fixing roller comprising a cylindrical light-transmitting base body capable of transmitting a heat ray; a light-transmitting elastic layer including a first light-transmitting elastic layer provided on an outer periphery of said light-transmitting base body and made of a material having a hardness A1, and a second light-transmitting elastic layer provided on an outer periphery of said first light-transmitting elastic layer and made of a material having a hardness A2; and a heat ray absorbing layer provided on an outer periphery of said light-transmitting elastic layer and to absorb said heat ray.

6 Claims, 8 Drawing Sheets

FIXING DEVICE FOR IMAGE-FORMING APPARATUS

BACKGROUND OF THE INVENTION

The present invention relates to a fixing device incorporated into image-forming apparatus such as a copier, a printer, a facsimile and a composite apparatus having those functions, and also relates to a fixing roller employed for the fixing device.

Conventionally, a heat roller fixing method, in which a fixing roller, maintained at a required temperature, and a pressing roller, having an elastic layer and press-contacting to the fixing roller, apply heat and pressure to a non-fixed toner image transferred onto a transfer material, while conveying the transfer material, has been widely employed for the fixing devices incorporated into electro-photographic image-forming apparatus such as a copier, a printer, a facsimile, a composite apparatus having those functions, etc., ranging from low-speed apparatus to high-speed apparatus, and from monochrome apparatus to color apparatus.

In the fixing device employing the conventional heat roller fixing method, however, there have been problems that, since it is necessary to heat up the fixing roller having a large heat capacity when applying heat to toner and the transfer material, the efficiency of saving electronic energy is hardly improved and therefore the fixing device is disadvantageous in energy saving point of view, and further, it consumes much time to heat up the fixing device to the required temperature at an initial time of the image-forming operation, resulting in a long warming-up time required for starting the image-forming operation.

To overcome the abovementioned problems, fixing devices, employing a quick start fixing method, are set forth in Tokkaisho 52-106741, Tokkaisho 57-82240, Tokkaisho 57102736, Tokkaisho 57-102741 and Tokkaihei 11-327342, and are well known. In such a quick start fixing method, a fixing roller, which comprises a light-transmitting elastic layer equipped on an outer circumferential surface of a cylindrical light-transmitting base body and a heat absorptive layer equipped on an outer circumferential surface of the light-transmitting elastic layer, applies heat and pressure to a toner image on the transfer material, after the heat absorptive layer absorbs heat rays emitted from a halogen lamp disposed inside the light-transmitting base body.

FIG. 7 shows a longitudinal cross-sectional view of fixing roller 71 and pressing roller 72 mounted in a fixing device, embodied in the conventional quick start method mentioned above. FIG. 8 shows a lateral cross-sectional view of fixing roller 71 and pressing roller 72 employed for the conventional fixing device. Incidentally, the structure and operations of the conventional fixing device shown in FIG. 7 will be detailed later, referring to FIG. 4 in which a fixing device embodied in the present invention is shown, and the same members are respectively indicated by the same reference numbers.

As shown in FIG. 8, conventional fixing roller 71 comprises light-transmitting elastic layer 71*b*, made of a light-transmitting silicon rubber, and heat absorptive layer 71*c*, which are sequentially laminated on the outer circumferential surface of light-transmitting base body 71*a* being a hollow cylinder. While, pressing roller 72 comprises elastic member 72*b*, made of a silicon rubber etc., which is covered on the outer circumferential surface of core metal member 72*a* being a hollow cylinder made of a metal, such as, for instance, an aluminum alloy, etc.

Further, in the conventional fixing device shown in FIG. 7, light-transmitting base body 71*a* is inserted into bearing 71*d* to rotatably support fixing roller 71, which is driven by gear 78 geared with the reduction gear of the driving means (not shown in the drawings). While both end portions of core metal member 72*a* are inserted into bearing members 72*c* to rotatably support pressing roller 72, which is urged toward fixing roller 71 by springs 72*d* to make pressing roller 72 press-contacts fixing roller 71., When fixing roller 71 rotates, pressing roller 72 also rotates as a driven roller of fixing roller 71, and a nip portion, formed by the press-contacting action between elastic member 72*b* of pressing roller 72 and light-transmitting elastic layer 71*b* of fixing roller 71, applies heat and pressure onto the toner image on the transfer material while conveying the transfer material to fix the toner image.

However, since a glass pipe or a polyimide resin material, etc., being good in heat-resistant property, strength, transparency, etc., while being bad in circularity accuracy of the outer diameters of them, is employed for light-transmitting base body 71*a*, unevenness around the outer circumferential surface of light-transmitting base body 71*a* would exist, or it is difficult to make the rotational axis of the outer-diameter of light-transmitting elastic layer 71*b*, formed on the outer circumferential surface of light-transmitting base body 71*a*, coincided with that of light-transmitting base body 71*a*. Accordingly, a certain deviation (for instance, around 0.5 mm) has occurred between both axes.

Accordingly, there has been a problem that, when bearing 71*d* is fitted on the outer circumferential surface of light-transmitting base body 71*a* to rotate fixing roller 71 as shown in FIG. 7, the outer diameter of light-transmitting base body 71*a* eccentrically rotates corresponding to the deviation of the rotational center axis, and a nip pressure generated at the nip portion varies with the rotation of fixing roller 71, resulting in unevenness of the fixed toner image.

Further, there has been another problem that irregularities of the outer circumferential surface of light-transmitting base body 71*a* are transmitted to the nip portion, resulting in occurrences of wrinkles on the transfer material or non-uniformity of the fixed toner image.

Still further, there has been another problem that, since a bearing, etc., including oily lubricant, is conventionally employed for bearing 71*d*, a heat, transmitted from light-transmitting base body 71*a* in the thermal conducting process, promotes the evaporation of oily lubricant included in bearing 71*d*, and as a result, bearing 71*d* deteriorates within a very short time period.

Still further, since the length of pressing roller 72 is shorter than the length of fixing roller 71 in the conventional fixing device, stresses generated in light-transmitting elastic layer 71*b* for opposing the pressing force concentrate in the vicinity of both end portions of pressing roller 72. Accordingly, there has been a problem that the nip pressure in the vicinity of both end portions of pressing roller 72 becomes extraordinarily high, resulting in occurrences of wrinkles on the transfer material or unevenness of the fixed toner image in the width direction.

SUMMARY OF THE INVENTION

The invention has been achieved in view of the problems of the prior art stated above, and its first object is to provide a fixing device of a quick start type wherein a first light-transmitting elastic layer made of a material having hardness A1 is provided on the outside of a light-transmitting base body and a second light-transmitting elastic layer made of a material having hardness A2 is provided on the outside of the first light-transmitting elastic layer, while, hardness A2 is established to be lower than hardness A1 and a thickness of the second light-transmitting elastic layer is established to be greater than that of the first light-transmitting elastic layer, and thereby, fluctuation of nipping pressure caused by eccentricity at a nipping portion and unevenness of nipping pressure caused by unevenness on an outer circumferential surface of light-transmitting base body 71*a* are prevented, so that uniform fixing of toner images is made possible.

The second object of the invention is to provide a fixing device of a quick start type wherein a bearing member is made to fit on an outside diameter of a light-transmitting elastic layer or of a heat absorbing layer through a heat insulating member, a fixing roller is rotated around the central axis for rotation of an outside diameter of the light-transmitting elastic layer, and heat conduction to the bearing member is intercepted by the heat insulating member, so that prevention of fluctuation of nipping pressure caused by eccentricity at the nipping portion and prevention of deterioration of the bearing member are made possible.

The above object can be attained by the following structures.

(1) A fixing apparatus for fixing a toner image on a transfer sheet, comprises:
- a fixing roller comprising
- a cylindrical light-transmitting base body capable of transmitting a heat ray;
- a light-transmitting elastic layer including
  - a first light-transmitting elastic layer provided on an outer periphery of said light-transmitting base body and made of a material having a hardness A1, and
- a second light-transmitting elastic layer provided on an outer periphery of said first light-transmitting elastic layer and made of a material having a hardness A2; and
- a heat ray absorbing layer provided on an outer periphery of said light-transmitting elastic layer and to absorb said heat ray.

(2) In the fixing apparatus of (1), the hardness A1 is greater than the hardness A2.

(3) In the fixing apparatus of (1), the material of at least one of the first light-transmitting elastic layer and the second light-transmitting elastic layer is a silicone rubber.

(4) In the fixing apparatus of (1), a thickness T1 of the first light-transmitting elastic layer is not larger than a thickness T2 of the second light-transmitting elastic layer.

(5) In the fixing apparatus of (1), the fixing apparatus further comprises:

a bearing to support the fixing roller rotatably, said bearing provided on an outer periphery of said light-transmitting elastic layer or an outer periphery of said heat ray absorbing layer.

(6) The fixing apparatus of (5), the fixing apparatus further comprises:

a heat insulating member to intercepting heat transmission from said light-transmitting elastic layer or said heat ray absorbing layer to said bearing, wherein said heat insulating member is provided on an outer periphery of said light-transmitting elastic layer or an outer periphery of said heat ray absorbing layer and said bearing is provided on an outer periphery of said heat insulating member.

(7) In the fixing apparatus of (6), a material at said heat insulating member has a heat deformation temperature higher than 200° C. under a load of 18.6 Kg/cm$^2$.

DETAILED DESCRIPTION OF THE PREFERRED EMBODIMENT

Figure 1:
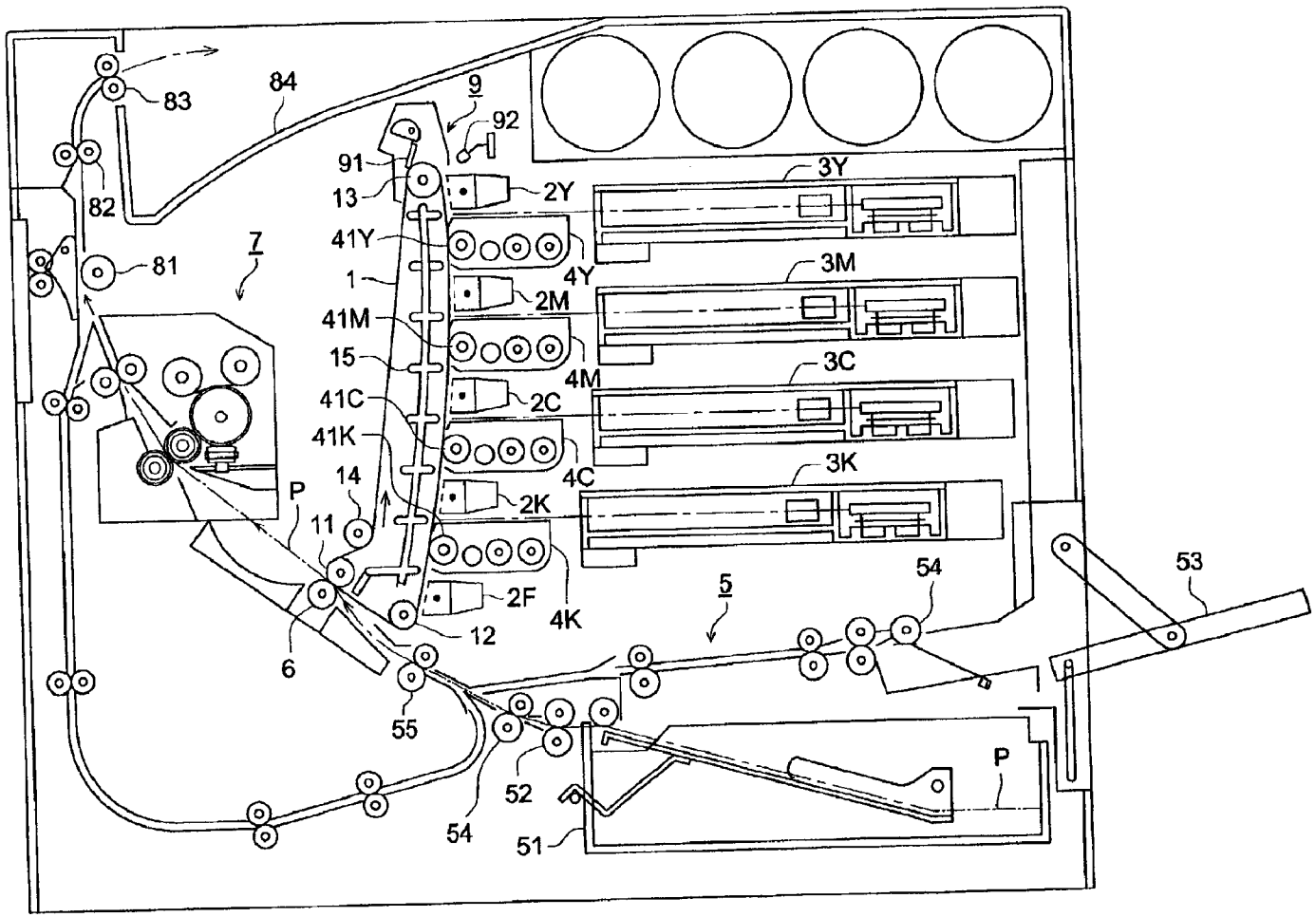
FIG. 1 is a structural diagram showing the structure of a color printer representing an image forming apparatus equipped with a fixing device of the invention.

An image-forming apparatus incorporating the fixing device, embodied in the present invention, will be detailed in the following, referring to drawings. FIG. 1 shows a structural block-diagram of a color printer, serving as an image-forming apparatus incorporating the fixing device, embodied in the present invention.

In the color printer, four sets of image-forming units, each of which comprises each of four sets of scorotron chargers (hereinafter, referred to as chargers) 2Y, 2M, 2C, 2K, each of four sets of image-exposing devices 3Y, 3M, 3C, 3K and each of four sets of developing devices 4Y, 4M, 4C, 4K, are arranged in a vertical direction along the periphery of endless-type flexible photoreceptor belt 1 (hereinafter, referred to as photoreceptor belt 1), serving as an image bearing element. Incidentally, a laser-beam scanning optical system is employed in each of image-exposing devices 3Y, 3M, 3C, 3K.

Photoreceptor belt 1, which is threaded on driving roller 11, lower roller 12 and upper roller 13 and stretched by tension roller 14, rotates clockwise in the arrow direction shown in FIG. 1, while partially contacting back-up member 15 located in the inner circumferential surface of photoreceptor belt 1. Back-up member 15 positions photoreceptor belt 1 at focal points of image-exposing devices 3Y, 3M, 3C, 3K and at developing regions of developing devices 4Y, 4M, 4C, 4K, by contacting the back surface of photoreceptor belt 1.

When the image-forming operation starts, the driving motor (not shown in the drawings) drives driving roller 11 to rotate photoreceptor belt 1 clockwise in the direction designated by the arrow, and photoreceptor belt 1 is charged at a certain electronic potential by the charging action of charger 2Y. After photoreceptor belt 1 is charged at a required electronic potential, image-exposing device 3Y exposes a laser-beam, modulated by the first image signals of yellow color Y, onto photoreceptor belt 1 to form a latent image, corresponding to a developed image of yellow color Y, on the surface of photoreceptor belt 1 with its rotating action (sub-scanning). Then, developing device 4Y conducts the reversal development in such a manner that the developer, adhered onto developer bearing sleeve 41Y, is conveyed to the developing region to develop the latent image of yellow color Y into a toner image of yellow color Y in a non-contacting state.

Next, photoreceptor belt 1 is charged again at a required electronic potential over the toner image of yellow color Y by the charging action of charger 2M, and image-exposing device 3M exposes a laser-beam, modulated by the second image signals of magenta color M, onto photoreceptor belt 1 to form a latent image, corresponding to a developed image of magenta color M, on the surface of photoreceptor belt 1 with its rotating action (sub-scanning). Then, developing device 4M conducts the reversal development of a non-contacting state in the same manner as that of yellow color Y to form a toner image of magenta color M, overlapped on the toner image of color Y.

In the same process as mentioned above, a toner image of cyan color C, corresponding to the third image signals of cyan color C, is formed by charger 2C, image-exposing device 3C and developing device 4C. Further, a toner image of black color K, corresponding to the fourth image signals of black color K, is formed by charger 2K, image-exposing device 3K and developing device 4K. Accordingly, the toner images of colors Y, M, C, K are sequentially formed on photoreceptor belt 1 while overlapping one by one, and as a result, a full color toner image is formed during one revolution of photoreceptor belt 1.

After charger 2F uniforms the electronic potential of the toner adhered on photoreceptor belt 1, the full color toner image, formed on the periphery surface of photoreceptor belt 1, is conveyed to a transferring region. Transfer material P, which is pulled out from either paper-feeding cassette 51 of paper-feeding device 5 or manual paper-feeding tray 53 by corresponding paper-feeding roller pair 52 or 54 and conveyed to resist roller pair 55, is fed to the transferring region in synchronism with the passing action of the full color toner image on photoreceptor belt 1 by the driving action of resist roller pair 55. Then, at the transferring region, the full color toner image is transferred onto transfer material P by means of transferring device 6 disposed opposite driving roller 11.

Transfer material P, on which the full color toner image is already transferred, is separated from the outer circumferential surface of photoreceptor belt 1 and conveyed to fixing device 7, in which the full color toner image is fused and fixed onto transfer material P. After the fixing process is completed, transfer material P is further conveyed to delivery tray 84 equipped on the upper side of the color printer by delivery roller pairs 81, 82, 83.

On the other hand, after transfer material P is separated from photoreceptor belt 1, cleaning blade 91 of cleaning device 9 cleans off the residual toner from the outer circumferential surface of photoreceptor belt 1. Incidentally, when the toner-image-forming operation of the next document is successively performed, the hysteresis of the previous electronic charged pattern is eliminated by exposing the outer circumferential surface of photoreceptor belt 1 by means of pre-discharger 92.

Figure 2:
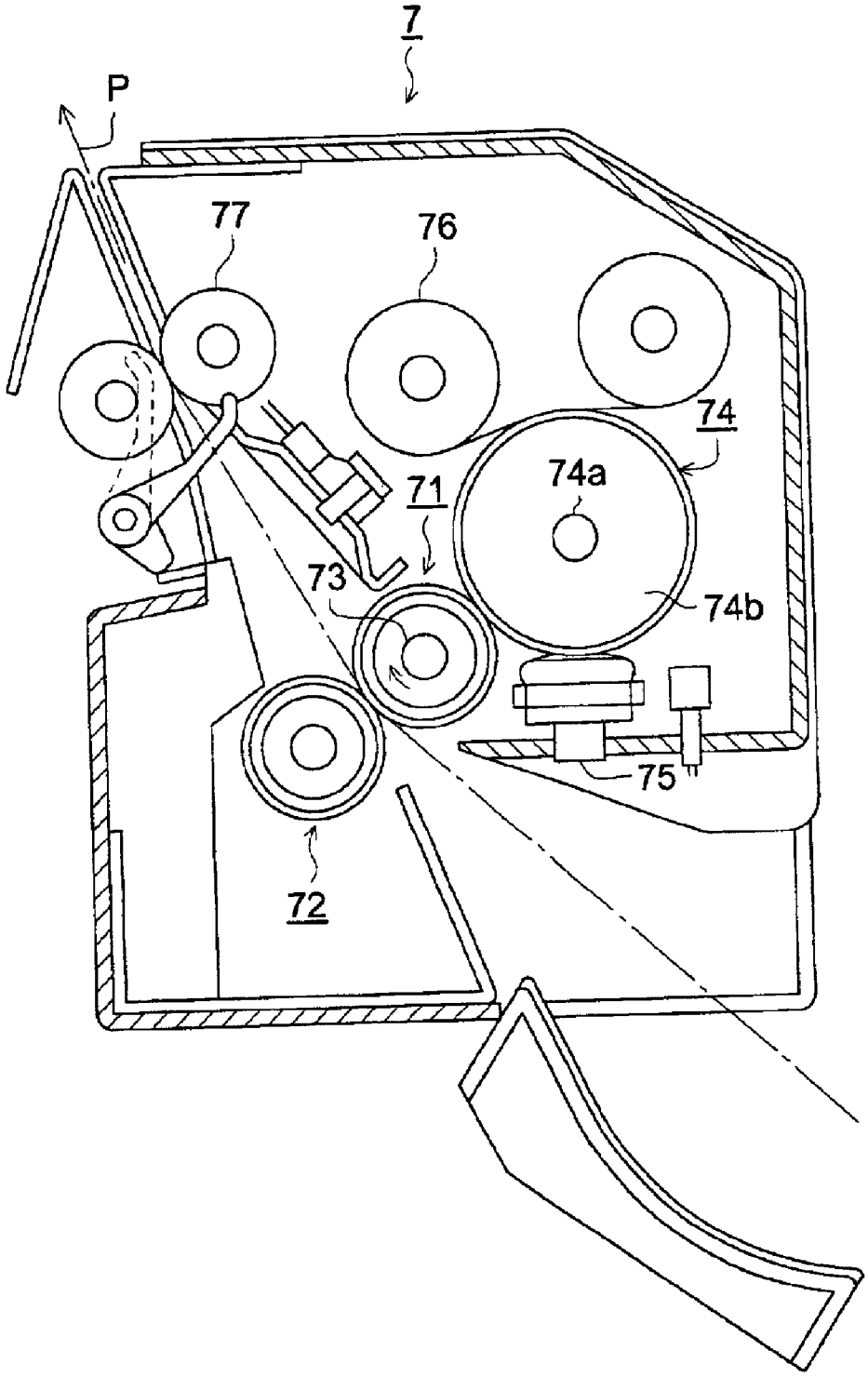
FIG. 2 is a sectional view showing the internal structure of a fixing device of the invention.
Figure 3:
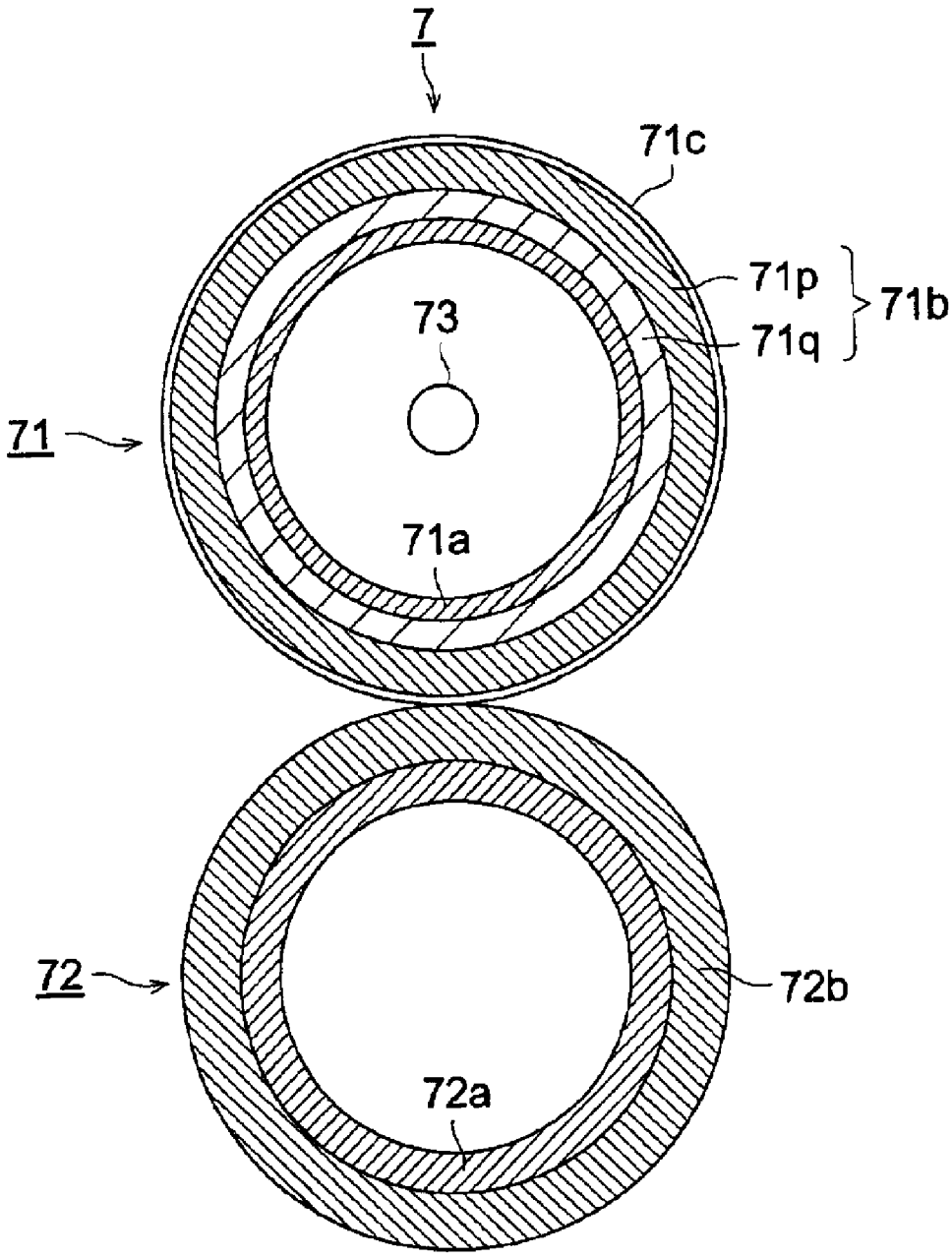
FIG. 3 is an enlarged sectional view of primary portions of a fixing device composed of a fixing roller, a pressure roller and a halogen heater.
Figure 4:
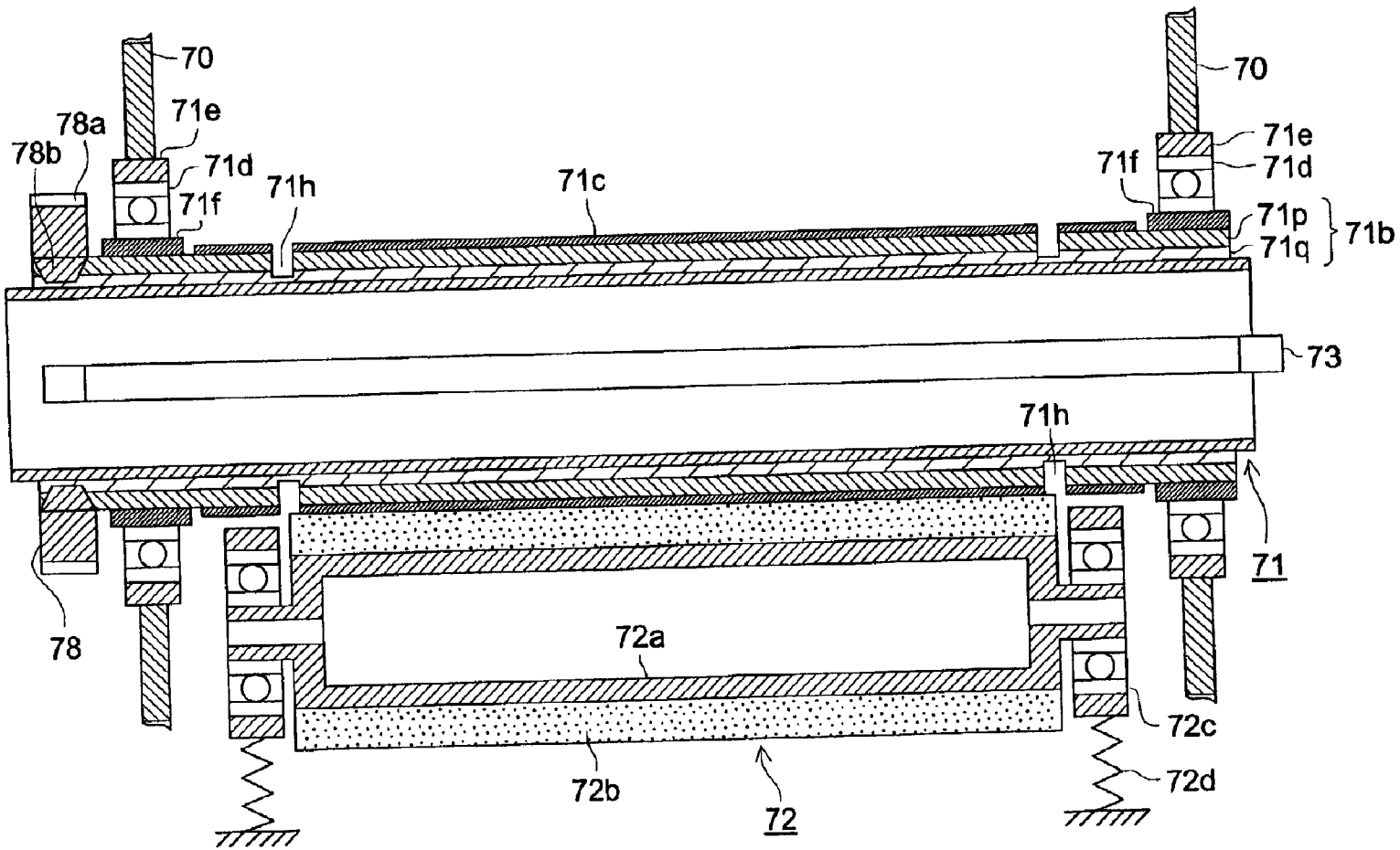
FIG. 4 is a sectional top view of a fixing device showing the first embodiment of the invention.

FIG. 2 shows a cross-sectional view of fixing device 7, indicating its inner structure. FIG. 3 shows a lateral cross-sectional view of the main part of fixing device 7, including fixing roller 71, pressing roller 72 and halogen heater 73. FIG. 4 shows a longitudinal cross-sectional view of a fixing device, indicating the first embodiment of the present invention.

As shown in FIG. 2, fixing device 7 comprises fixing roller 71 employing light-transmitting base body 71*a*, pressing roller 72, halogen heater 73 serving as a heat source, cleaning roller 74, cleaning pad 75, oil applying member 76, feed-out roller pair 77, etc. Further, cleaning roller 74 comprises rotating shaft 74*a*, both end portions of which are rotatably inserted into bearing members (not shown in the drawings) fitted into left and right side plates 70 of fixing device 7, and elastic member 74*b*, which is a roller made of a heat-resistant resin material, such as foamed silicon rubber, etc.

Light-transmitting base body 71*b* is a hollow cylinder made of a heat-resistant glass material or a heat-resistant resin material. In the first embodiment of the present invention shown in FIG. 4, a hollow cylinder, made of the Pyrex glass (manufactured by Corning Co. in the U.S.A.) and having dimensions of 28 mm outer diameter and 1.5 mm thickness, is employed for light-transmitting base body 71*a*, through which infrared or far infrared heat rays, irradiated from halogen heater 73 serving as a heat source, can penetrate.

As shown in FIG. 3, fixing roller 71 comprises light-transmitting elastic layer 71*b* having a double layer structure in which the first light-transmitting elastic layer 71*q*, made of a light-transmitting silicon rubber having hardness A1, and the second light-transmitting elastic layer 71*p*, made of a light-transmitting silicon rubber having hardness A2 are sequentially laminated on outer circumferential surface of light-transmitting base body 71*a* being a hollow cylinder. Further, heat absorptive layer 71*c*, having 0.05 mm thickness and made of a perfluoroalkoxy (PFA) including carbon powder, is laminated on outer circumferential surface of light-transmitting elastic layer 71*b*, so as to enable the aforementioned quick start operation of fixing roller 71.

Incidentally, hardness A1 of light-transmitting elastic layer 71*q* is set at, for instance, A1=56 (equivalent to the hardness of KE850, manufactured by Sinetu Chemical Co.) defined by JIS-K6301, while hardness A2 of light-transmitting elastic layer 71*p* is set at, for instance, A2=20 (equivalent to the hardness of KE520, manufactured by Sinetu Chemical Co.) also defined by JIS-K6301, namely, the values of A1 and A2 are selected under the condition of A1>A2, in which light-transmitting elastic layer 71*p* is softer than light-transmitting elastic layer 71*q*.

Further, thickness T1 of light-transmitting elastic layer 71*q* and thickness T2 of light-transmitting elastic layer 71*p* are set at, for instance, T1=1 mm and T2=1.5 mm, so that thickness T2 of light-transmitting elastic layer 71*p* is larger than thickness T1 of light-transmitting elastic layer 71*q*.

Since the hardness and thickness of the two layers of light-transmitting elastic layer 71*b* are set at the values as mentioned above, unevenness residing on the outer circumferential surface of light-transmitting base body 71*a* can be absorbed by light-transmitting elastic layer 71*q*.

In other words, since light-transmitting elastic layer 71*q* is formed by employing a mold put outside light-transmitting base body 71*a*, it is possible to improve roundness of an outside diameter of light-transmitting elastic layer 71*q* in an accuracy less than several tens μm. Further, absorbed unevenness on an outer circumferential surface of light-transmitting base body 71*a* is not transferred to the nipping section, because hardness of light-transmitting elastic layer 71*q* is set to be high, and its outer circumferential surface is covered by soft and thick light-transmitting elastic layer 71*p*.

Further, even when there exists eccentricity caused by deviation of the central axis for rotation of an outside diameter of the light-transmitting elastic layer 71*b*, it is possible to reduce an influence of fluctuation of nipping pressure caused by eccentricity at the nipping section, resulting in repression of occurrence the uneven fixing, because hardness of light-transmitting elastic layer 71*p* that comes directly into contact with the nipping section is set to be soft.

By providing two elastic layers as stated above, it is possible to design an elastic layer wherein functions are separated. For example, it is possible to realize elasticity that covers unevenness of light-transmitting base body 71*a* having a poor accuracy of an outside diameter and to realize elasticity capable of cooperating with a pressure roller and thereby of giving appropriate and uniform pressure. Namely, it is possible to give an optimum pressure while covering drawbacks of a light-transmitting base body.

It is further possible to use properly resistance to oil for fixing, resistance to heat and resistance to scratches in each layer by adapting to the level of the layer material. For example, with regard to the resistance to oil, stress is laid on a function to transmit no oil for an outer elastic layer and a material suitable for this function is used for the outer layer, and thereby, it is possible to prevent that oil soaks into an inner elastic layer. Namely, discoloration on an elastic layer caused by oil can be reduced remarkably, and thereby, light transmittance is maintained, and heat waves transmitted through a light-transmitting base body can be transferred effectively to a heat absorbing layer on the surface of a roller.

Next, in FIG. 4, heat waves emitted from halogen heater 73 are transmitted through light-transmitting base body 71*a*, light-transmitting elastic layer 71*q* and light-transmitting elastic layer 71*p* and are absorbed in heat absorbing layer 71*c*, thus, fixing roller 71 capable of heating quickly is formed.

Pressure roller 72 is one wherein an outer circumferential surface of hollow and cylindrical core metal member 72*a* made of metal such as aluminum alloy, for example, is covered by elastic member 72*b* such as silicone rubber. Both end portions of the core metal member 72*a* are supported rotatably by bearing members 72*c*. The bearing members 72*c* is urged by spring 72*d* to make the pressure roller 72 to be brought into pressure contact with fixing roller 71.

As shown in FIG. 4, light-transmitting elastic layer 71*b* lies up to vicinities of both end portions of the fixing roller 71 in the first embodiment of the invention, and heat insulating sleeve 71*f* representing a heat insulating member is fit on an outside diameter of each of both end portions of the light-transmitting elastic layer 71*b*. Further, bearing 71*d* representing a bearing member is fit on an outside diameter of the heat insulating sleeve 71*f* to support fixing roller 71 rotatably. The bearing 71*d* is fit and fixed in bearing holding member 71*e*, and the bearing holding member 71*e* is fixed on side plate 70 of a fixing device main body by an unillustrated screw-setting section.

The heat insulating sleeve 71*f* used here intercepts heat conduction from halogen heater 73 to bearing 71*d* through light-transmitting base body 71*a* and light-transmitting elastic layer 71*b* to prevent deterioration of bearing 71*d* caused by evaporation and solidification of lubricating oil. As a material of the heat insulating sleeve 71*f*, there is used, for example, 40% glass-reinforced polyphenylenesulfide (PPS) wherein heat deformation temperature under the load of 18.6 kg/cm$^2$ defined by JIS-K7207 is 236° C. and heat conductivity is 0.3 W/mK.

Further, in the first embodiment of the invention shown in FIG. 4, cut-out section 71*h* is provided at the portion where an end portion of pressure roller 72 comes in contact with light-transmitting elastic layer 71*b* and heat absorbing layer 71*c* to prevent that an end portion of pressure roller 72 comes in contact with fixing roller 71. With regard to the shape of the cut-out section 71*h*, for example, the cut-out section is formed by cutting a circumference of fixing roller 71 so that a width of the cut-out section in the longitudinal direction of fixing roller 71 is 5 mm and a depth of the cut-out section is 2 mm from the outer circumferential surface of heat absorbing layer 71*c*. A method to form the cut-out section 71*h* includes a method to form the shape of the cut-out section in the metal mold in advance when the light-transmitting elastic layer 71*b* is formed by a metal mold, and a method to form the cut-out section through turning processing by the use of a machine tool such as a lathe after forming the light-transmitting elastic layer 71*b*.

When this cut-out section 71*h* is present, a length of a pressed area on the light-transmitting elastic layer 71*b* is shorter than a length of pressure roller 72 on an equivalent basis, and therefore, the light-transmitting elastic layer 71*b* is deformed uniformly by pressure, and stress concentration against the pressure generated within the light-transmitting elastic layer 71*b* in the vicinity of an end portion of pressure roller 72 can be avoided, resulting in a uniform nipping pressure for the entire area of fixing a transfer material.

In particular, when the outermost layer of the pressure roller is made of hard material having no elasticity, for example, when a hard roller made of metal is used as a pressure roller, the stress concentration mentioned above has been generated conspicuously in the vicinity of an end portion of pressure roller 72 in the conventional fixing device, and it has been difficult to obtain uniform nipping pressure.

In the case of the foregoing, a fixing device to which the invention is applied provides an effect in particular, on the other hand, and nipping pressure can be made uniform for the entire area for fixing transfer materials independently of hardness of a pressure roller to be used, and occurrence of wrinkles on a transfer material and occurrence of uneven fixing in the lateral direction can be prevented.

In the embodiment of the invention stated above, fixing roller 71 is rotated around the central axis for rotation of an outside diameter of the light-transmitting elastic layer 71*b*, and fluctuation of nipping pressure caused by eccentricity at the nipping portion is effectively repressed, because bearing 71*d* is fit on an outside diameter of light-transmitting elastic layer 71*b* through heat insulating sleeve 71*f*, with regard to fixing roller 71.

Next, in FIG. 4, gear 78 representing a driving member to drive a fixing roller to rotate has, on the surface of its inside diameter, protrusion 78*b*, and is engaged with an outside diameter of light-transmitting elastic layer 71*b* on the left-most end portion thereof. Namely, when the gear 78 is made to engage with an outside diameter of the light-transmitting elastic layer 71*b*, the protrusion 78*b* cuts into the inside of the light-transmitting elastic layer 71*b* and thereby the gear 78 is fixed on the left end portion of the fixing roller 71.

Further, the gear 78 fixed on the fixing roller 71 is driven to rotate, with tooth portion 78*a* of the gear 78 engaged with a speed reduction gear connected to a driving means such as an unillustrated motor. When fixing roller 71 rotates, pressure roller 72 is driven by the fixing roller 71 to rotate in the arrow direction shown in FIG. 2 as a driven roller, and thereby, a transfer sheet is interposed and conveyed at the nipping portion and a toner image on the transfer sheet is fixed through heating and pressing.

Figure 5:
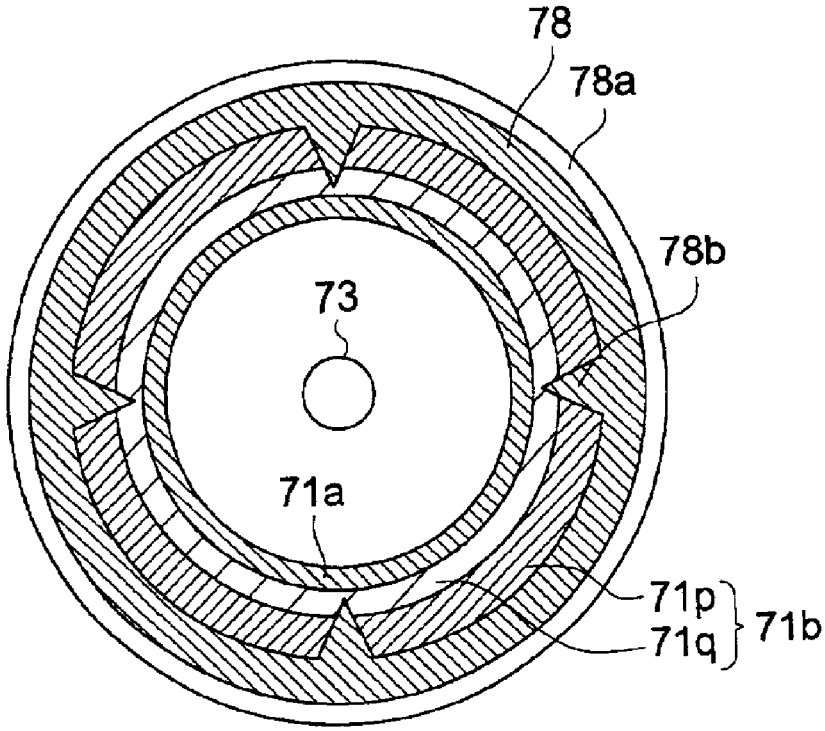
FIG. 5 is a sectional view of a gear-mounting section in the first embodiment of the invention.

FIG. 5 is a sectional view showing how gear 78 in FIG. 4 is mounted. As shown in FIG. 5, each of protrusions 78*b* provided at four locations, for example, on the surface of an inside diameter of gear 78 is in a shape of a wedge and is embedded deeply in light-transmitting elastic layer 71*b* until its tip portion arrives at light-transmitting elastic layer 71*q* whose hardness is high, so that rotational driving power given to the gear 78 is transmitted surely to the fixing roller.

Further, when the stronger connection between the gear 78 and light-transmitting elastic layer 71*b* is required, it is also possible to make the protrusion 78*b* to cut into the inside of the light-transmitting elastic layer 71*b* after applying adhesive agents on the surface of an inside diameter of the gear 78 or on the protrusion 78*b*, when fitting the gear 78 on an outside diameter of the light-transmitting elastic layer 71*b*.

Since the first embodiment of the invention is constructed as stated above, it is possible to drive a fixing roller to rotate around the central axis for rotation of an outside diameter of the light-transmitting elastic layer, and even when the fixing roller 71 is supported rotatably around an outside diameter of the light-transmitting elastic layer 71*b*, there is no occurrence of fluctuations of an engagement position between gear 78*a* and a speed reduction gear connected to a driving means such as an unillustrated motor, and occurrence of uneven rotary speed of the fixing roller can be prevented.

Figure 6:
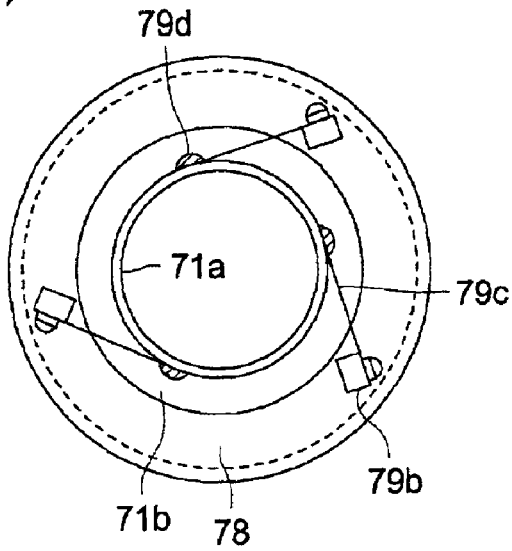
FIG. 6(*a*) is a front view of a gear-mounting section in the second embodiment of the invention, showing a side view that shows how gears are connected with a light-transmitting base body and FIG. 6(*b*) is a sectional top view of the inner side of the side plate of a fixing device main body.
Figure 6:
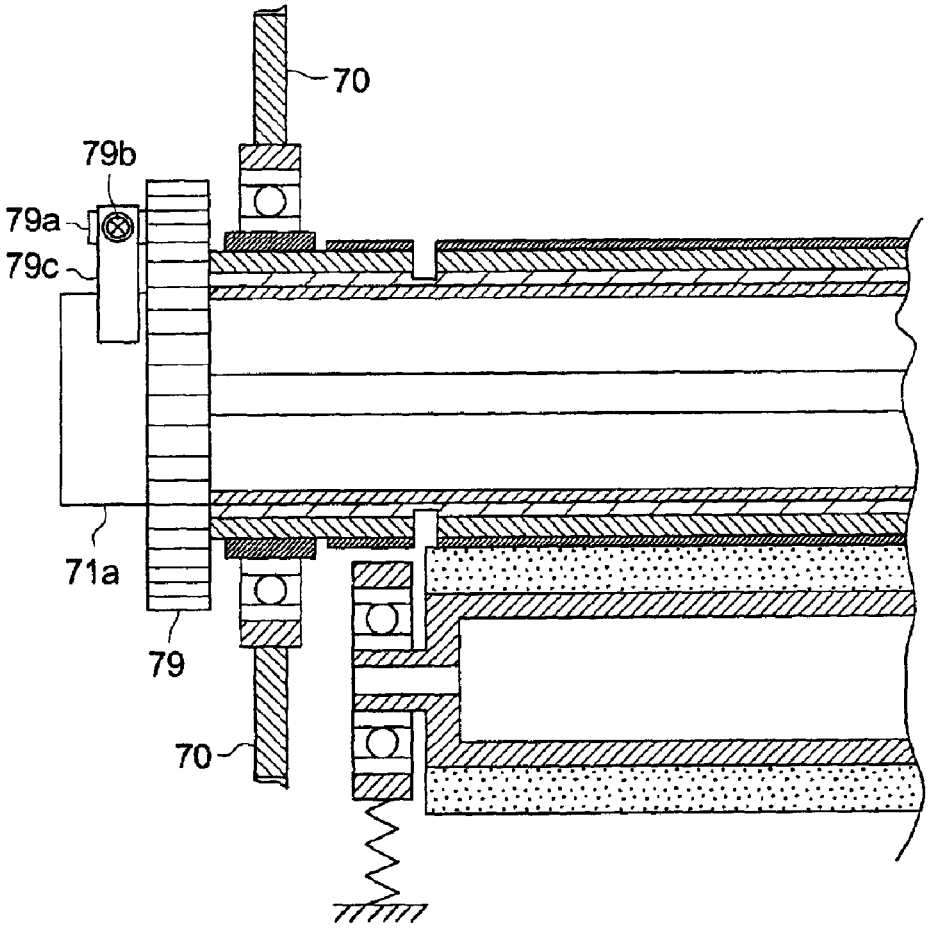
Figure 7:
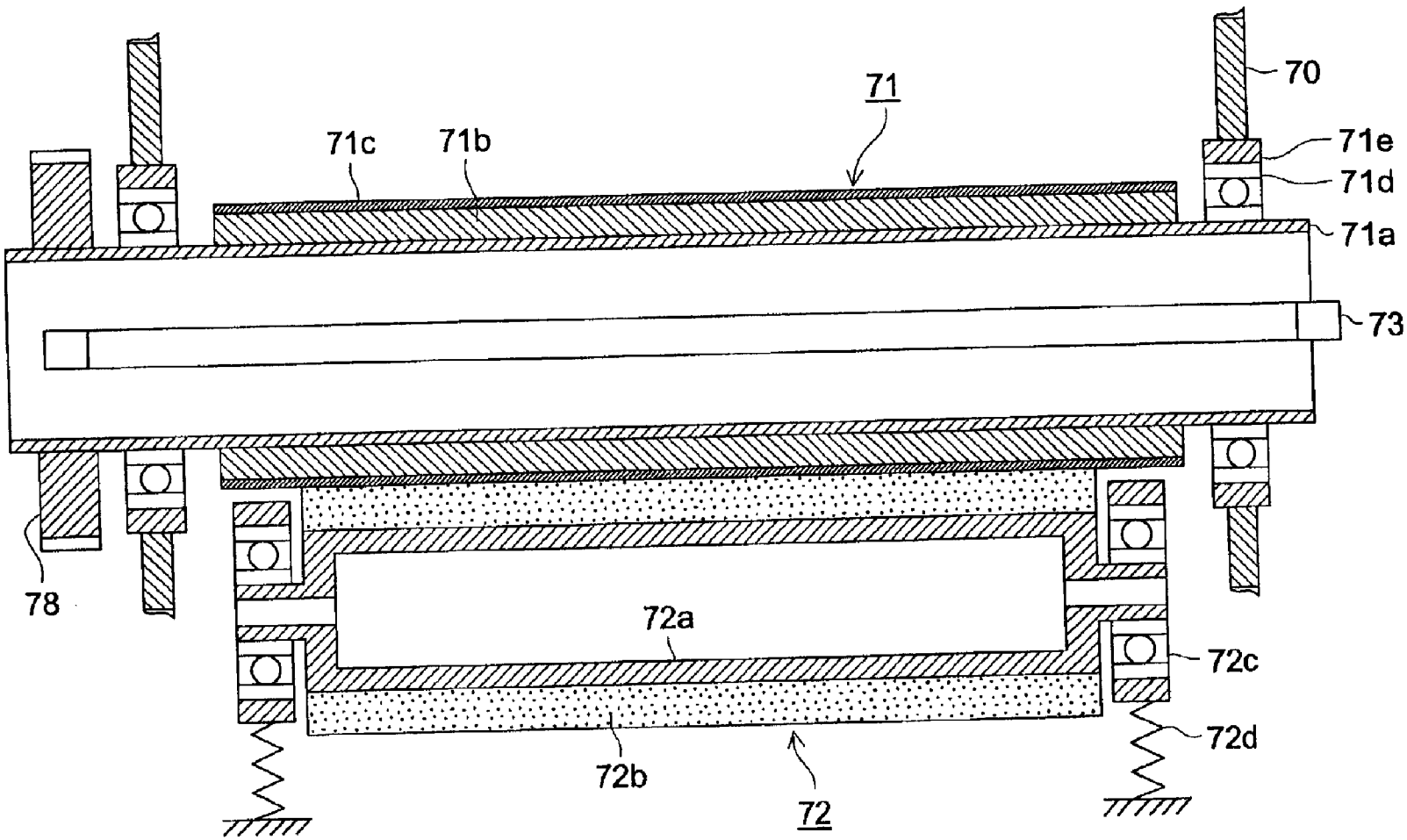
FIG. 7 is a sectional top view of each of a fixing roller and a pressure roller both mounted on a fixing device main body in the conventional fixing device of a quick start type.
Figure 8:
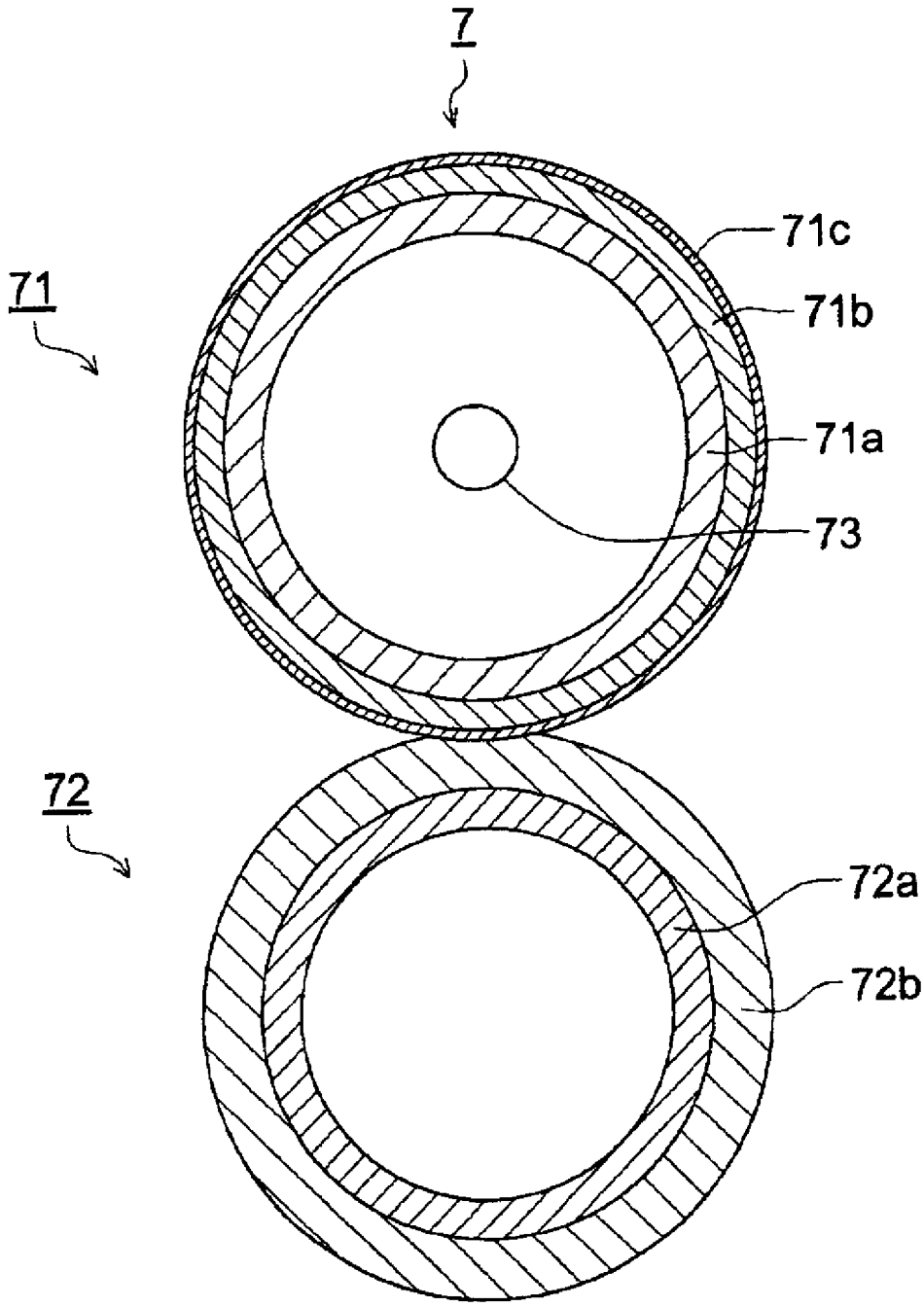
FIG. 8 is an enlarged sectional view of primary portions of a fixing device composed of a fixing roller, a pressure roller and a halogen heater in the conventional fixing device of a quick start type.

Next, FIG. 6 shows the second embodiment of the invention which will be explained in detail as follows. FIG. 6(*a*) is a side view of fixing roller 71 viewed from the side which shows how gear 79 is connected with light-transmitting base body 71*a*. FIG. 6(*b*) is a front view showing a portion where gear 79 is mounted, in which a top section in the inside of fixing device main body side plate 70 is shown together. In FIG. 6(*b*), the structure in the inner side from the fixing device main body side plate 70 is the same as that in the first embodiment shown in FIG. 4, and therefore, explanation therefor will be omitted.

In FIG. 6, light-transmitting elastic layer 71*b* is extended to the lower portion of gear 79 in the same way as the first embodiment shown in FIG. 4, and gear 79 is fit on an outside diameter of the light-transmitting elastic layer 71*b*. Gear 79 does not have a protrusion that cuts into the inside of the light-transmitting elastic layer 71*b*, but it has protruded portions 79*a* (for example, formed at illustrated three locations) formed integrally with the gear 79 on the side face of the gear 79, and one end portion of connection member 79*c* is fixed by screw 79*b* on the screw-setting surface of the protruded portion 79*a*. The screw-setting surface of the protruded portion 79*a* is formed to be inclined for the central line of the gear 79 so that the other end portion of the connection member 79*c* set with screws may come in contact with light-transmitting base body 71*a*.

On the portion that is on the left side from the point where gear 79 is mounted on fixing roller 71, there is not provided light-transmitting elastic layer 71*b*, and light-transmitting base body 71*a* is exposed. Therefore, the other end portion of connection member 79*c* that is set with screws is in contact with the light-transmitting base body 71*a*.

On the portion where the other end portion of the connection member 79*c* is in contact with the light-transmitting base body 71*a*, there are applied adhesive agents 79*d* so that the other end portion of the connection member 79*c* is fixed on the light-transmitting base body 71*a*, and gear 79 is connected mechanically to the light-transmitting base body 71*a* through the connection member 79*c*.

A material of the connection member 79*c* has only to be an elastic and heat-resistant sheet member, and it is preferable to use a metal sheet (for example, steel sheet and phosphor bronze).

Since a temperature rises to high temperature of about 200° C. at a portion where the other end portion of the connection member 79*c* is glued on the light-transmitting base body 71*a*, it is preferable to use adhesive agents having heat resistance for high temperature of 200° C. or more (for example, liquid state epoxy-belended resin 2285 made by Three Bond Company) as adhesive agent 79*d*.

Since the second embodiment of the invention is constructed as stated above, even when the central axis for rotation of an outside diameter of the light-transmitting elastic layer 71*b* does not agree with the central axis for rotation of an outside diameter of the light-transmitting base body 71*a* and deviation is caused accordingly, it is possible to transmit driving power for rotation to the light-transmitting base body 71*a* while connection member 79*c* absorbs the deviation flexibly.

Since gear 79 is fit on an outside diameter of light-transmitting elastic layer 71*b*, fixing roller 71 rotates around the central axis for rotation of an outside diameter of light-transmitting elastic layer 71*b*.

Therefore, it is possible to prevent occurrence of uneven rotary speed of a fixing roller caused by fluctuation of nipping pressure in the nipping section and fluctuation of an engagement position of gear 79 both arising from eccentricity, without giving an influence such as a load of driving power to light-transmitting elastic layer 71*b*.

Incidentally, the embodiment of the invention described above shows the best mode to which the invention is applied, and the structure and numerals described above do not limit the scope of the invention.

For example, though there is shown a mode wherein bearing 71*d* is fit on an outside diameter of light-transmitting elastic layer 71*b* through heat insulating sleeve 71*f* in the first embodiment shown in FIG. 4, it is also possible to employ a mode to fit bearing 71*d* directly on an outside diameter of light-transmitting elastic layer 71*b* through no heat insulating sleeve 71*f*. Further, though there has been shown the structure wherein no heat absorbing layer is present on the fitting portion for bearing 71*d*, it is also possible to employ the structure where the heat absorbing layer is present. Further, though the number of protrusions 78*b* of gear 78 has been explained to be four, the number may also be one, or a large number of small protrusions may also be provided. These are all included in the scope of the invention.

Though an example wherein a color printer is equipped with the fixing device of the invention as an image forming apparatus has been shown in the embodiment stated above, it is naturally possible to apply the invention to a monochromatic copying machine, a monochromatic printer, a facsimile machine and all other image forming apparatuses requiring a fixing device for toner images, in the same way as in the embodiment stated above.

As explained in detail above, the inventions described in Structures (1)–(4) make it possible to obtain an effect to provide a fixing device wherein a first light-transmitting elastic layer made of a material having hardness A1 is provided on the outside of a light-transmitting base body and a second light-transmitting elastic layer made of a material having hardness A2 is provided on the outside of the first light-transmitting elastic layer, while, hardness A2 is established to be lower than hardness A1 and thickness T2 of the second light-transmitting elastic layer is established to be greater than thickness T1 of the first light-transmitting elastic layer, and thereby, unevenness of nipping pressure caused by unevenness on an outer circumferential surface of the light-transmitting base body at a nipping portion and fluctuation of nipping pressure caused by eccentricity of an outside diameter of the light-transmitting elastic layer are prevented, so that uniform fixing of toner images is made possible.

The inventions described in Structures (5)–(7) make it possible to obtain an effect to provide a fixing device wherein a bearing member is made to fit on an outside diameter of a light-transmitting elastic layer or of a heat absorbing layer through a heat insulating member, and thereby a fixing roller is rotated around the central axis for rotation of an outside diameter of the light-transmitting elastic layer, and heat conduction to the bearing member can be intercepted by the heat insulating member, so that fluctuation of nipping pressure caused by eccentricity of an outside diameter of the light-transmitting elastic layer at the nipping portion and deterioration of the bearing member of the fixing roller can be prevented.

What is claimed is:

1. A fixing apparatus for fixing a toner image on a transfer sheet, comprising:

a fixing roller comprising a cylindrical light-transmitting base body, made of a glass material capable of transmitting a heat ray;

a light-transmitting elastic layer including a first light-transmitting elastic layer provided on an outer periphery of said light-transmitting base body and made of a material having a hardness Al, and a second light-transmitting elastic layer provided on an outer periphery of said first light-transmitting elastic layer and made of a material having a hardness A2, wherein the hardness A1 is greater than the hardness A2; and a heat ray absorbing layer provided on an outer periphery of said light-transmitting elastic layer and to absorb said heat ray.

2. The fixing apparatus of claim 1, wherein the material of at least one of the first light-transmitting elastic layer and the second light-transmitting elastic layer is a silicone rubber.

3. The fixing apparatus of claim 1, wherein a thickness T1 of the first light-transmitting elastic layer is not larger than a thickness T2 of the second light-transmitting elastic layer.

4. The fixing apparatus of claim 1, further comprising:

a bearing to support the fixing roller rotatably, said bearing provided on an outer periphery of said light-transmitting elastic layer or an outer periphery of said heat ray absorbing layer.

5. The fixing apparatus of claim 4, further comprising:

a heat insulating member to intercepting heat transmission from said light-transmitting elastic layer or said heat ray absorbing layer to said bearing, wherein said heat insulating member is provided on an outer periphery of said light-transmitting elastic layer or an outer periphery of said heat ray absorbing layer and said bearing is provided on an outer periphery of said heat insulating member.

6. The fixing apparatus of claim 5, a material of said heat insulating member has a heat deformation temperature higher than 200° C. under a load of 18.6 $Kg/cm^2$.

* * * * *